US005311819A

United States Patent [19]

Silvia

[11] Patent Number: 5,311,819

[45] Date of Patent: May 17, 1994

[54] EXPLOSIVE LOGIC NETWORK

[75] Inventor: Denis A. Silvia, Aberdeen, Md.

[73] Assignee: The United States of America as represented by the Secretary of the Army, Washington, D.C.

[21] Appl. No.: 874,200

[22] Filed: May 23, 1986

[51] Int. Cl.[5] ..... F42C 19/095

[52] U.S. Cl. ..... 102/200; 102/701

[58] Field of Search ..... 102/200, 221, 275.9, 102/293, 305, 701

[56] References Cited

U.S. PATENT DOCUMENTS

| | | | |
|---|---|---|---|
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 102/275.9 |
| 3,753,402 | 8/1973 | Menz et al. | 102/701 |
| 3,768,409 | 10/1973 | Menz et al. | 102/275.9 |
| 3,973,499 | 8/1976 | Anderson et al. | 102/701 |
| 4,412,493 | 11/1983 | Silvia | 102/701 |

*Primary Examiner*—Charles T. Jordan

*Attorney, Agent, or Firm*—Thomas McDonald; Saul Elbaum

[57] ABSTRACT

An explosive logic network, including a first explosive path which is crossed by second explosive paths such at a detonation propagating along the second path in either direction would cut and open a first end of the first path, and will be propagated at an opposite second end of the first path. The two paths are connected by explosive logic elements such that a detonation propagating from the first end to the second end of the first path will also be propagated in both directions along the second path, and a detonation propagating from the second end to the first end of the first path will cut and open both ends of the second path.

18 Claims, 4 Drawing Sheets

EXPLOSIVE LOGIC NETWORK

RIGHTS OF THE GOVERNMENT

The invention described herein may be manufactured, used or licensed by the United States Government for governmental purposes without the payment to me of any royalty thereon.

CROSS-REFERENCE TO RELATED APPLICATIONS

Cross-reference is made to my U.S. patent application, Ser. No. 797,062, filed Nov. 12, 1985, which describes an explosive logic null gate concept used in the invention described herein. Cross reference is also made to my U.S. patent application, Ser. No. 874,206, filed May 23, 1986, entitled "Self Limiting Explosive Logic Network", which describes a logic network in which the present invention can be advantageously incorporated.

BACKGROUND OF THE INVENTION

The invention relates generally to explosives and particularly to explosive initiation mechanisms, specifically explosive logic networks.

In the past, explosive logic systems have been used as explosive mechanisms or in safe-and-arm devices for missiles, projectiles, or other weapon systems. Null gates are included in some systems, which function to switch off, or disrupt, a circuit. This is accomplished by breaking through the explosive material in a trail with a detonation from another intersecting trail. One type of null gate, utilizing the "corner effect" principle, is disclosed in U.S. Pat. No. 4,412,493, issued Nov. 1, 1983 to Silvia. Also, U.S. Pat. No. 3,768,409, issued Oct. 30, 1973 to Menz et al describes destructive crossovers which utilize the "corner effect". However, in both of these explosive logic devices, it is difficult to assure very high reliability, approaching 100%, because of variability in the corner radius and explosive materials. In explosive logic systems which require large numbers of such null gates or destructive crossovers, these elements must have a very high reliability in order to ensure an acceptable overall system reliability.

U.S. Pat. No. 3,430,564, issued Mar. 4, 1969 to Silvia et al, discloses another type of explosive logic device wherein a point contact from an explosive trail with a constricted region of another explosive trail produces a destructive crossover, in which a detonation through the point contact of the one trail physically disrupts the constricted region of the other trail. However, explosive logic devices utilizing this principle tend to be much slower than corner base logic. Consequently, when a large number of such devices are required in an explosive logic network, their slowness can degrade system performance.

SUMMARY OF THE INVENTION

It is an object of the invention to provide an explosive logic network having two intersecting explosive paths, in which one end of one path is reliably opened by a detonation propagated in either direction along the other path.

It is a further object of the invention to provide this network with explosive logic elements connected between the two paths so that a detonation propagating from one end of the one path will be propagated to both ends of the other path.

It is a still further object of the invention to provide this network with additional logic elements connected between the two paths so that a detonation propagating from the other end of the one path will not be propagated to either end of the one path.

An explosive logic network, according to the invention includes a first explosive path, and second and third explosive paths which are disposed on opposite sides of the first path and which intersect the first path at a first intersection. The second and third paths intersect the first path at respective acute angles such that a detonation propagating along either the second or third paths into the first intersection is allowed to propagate along the first path towards an inner end of the first path, but is not allowed to propagate along the first path towards an outer end of the first path.

Fourth and fifth explosive paths, which are disposed on opposite sides of the first path, intersect the first path at a second intersection intermediate the first intersection and the inner end of the first path such that a detonation propagating along the first path towards the inner end of the first path is also allowed to propagate along both the fourth and fifth paths away from the second intersection.

The fourth path, which is disposed on the same side of the first path as the second path, intersects the second path at a third intersection such that a detonation propagating along the fourth path away from the second intersection is allowed to propagate along the second path towards an outer end of the second path. Similarly, the fifth explosive path, which is disposed on the same side of the first path as the third path, intersects the third path at a fourth intersection such that a detonation propagating along the fifth path away from the second intersection is allowed to propagate along the third path towards an outer end of the third path.

The portion of the second path between the third intersection and the first intersection is shorter than the explosive path between the third intersection and the first intersection which passes through the second intersection. This assures that a detonation propagating along the second path towards the first intersection will always pass through the first intersection and open the outer portion of the first path before the same detonation can traverse the fourth path and be propagated across the first intersection to the outer portion of the first path. Similarly, the portion of the third path between the fourth intersection and the first intersection is shorter than the explosive path between the fourth intersection and the first intersection which passes through the second intersection. This assures that a detonation propagating along the third path towards the first intersection always passes through the first intersection and opens the outer portion of the first path before the same detonation can traverse the fifth path and be directed through the first intersection to the outer portion of the first path.

In some applications, it is desirable that a detonation propagating towards the first intersection along one of the second and third paths traverse the first path and continue along the other of the second and third paths away from the first intersection. This can be achieved in two ways:

(1) The fourth path can be made longer than the explosive path between the third intersection and the second intersection which passes through the first intersection, and the fifth path can be made longer than the explosive path between the fourth intersection and the second intersection which passes through the first intersection. In this way, a detonation propagating along the second path towards the first intersection will be diverted at the first intersection towards the inner end of the first path and into the fifth path before the same detonation can traverse the fourth path. Similarly, a detonation propagating along the third path towards the first intersection will be diverted at the first intersection towards the inner end of the first path and into the fourth path before the same detonation can traverse the fifth path and cut the first path at the third intersection.

(2) The second intersection can be designed to have no corner effect, so that a detonation entering the second intersection from one path will be propagated to all other paths entering this intersection. In this way, a detonation propagating along the second path towards the first intersection will propagate through the fourth path, the second intersection, and the fifth path to the third path. Similarly, a detonation propagating along the third path towards the first intersection will propagate through the fifth path, the second intersection, and the fourth path to the second path.

In some applications, it is desirable that a detonation propagating from the inner end of the first path not be propagated to the outer ends of either the second or third paths. To accomplish this, the explosive logic network can include sixth and seventh explosive paths which intersect the first path at a fifth intersection intermediate the second intersection and the inner end of the first path such that a detonation propagating from the inner end of the first path is also allowed to propagate along both the sixth and seventh paths away from the fifth intersection. The sixth path, which is disposed on the same side on the first path as the second path, intersects the second path at a sixth intersection intermediate the third intersection and the outer end of the second path at an acute angle such that a detonation propagating along the sixth path into the sixth intersection is allowed to propagate along the second path towards the third intersection but is not allowed to propagate along the second path towards the outer end of the second path. Similarly, the seventh path which is disposed on the same side of the first path as the third path, intersects the third path at a seventh intersection intermediate the fourth intersection and the outer end of the third path at an acute angle such that a detonation propagating along the seventh path into the seventh intersection is allowed to propagate along the third path towards the fourth intersection but is not allowed to propagate along the third path towards the outer end of the third path. The sixth path is the shortest explosive path between the fifth intersection and the sixth intersection, and the seventh path is the shortest explosive path between the fifth intersection and the seventh intersection.

In this embodiment of the invention, any detonation propagating from the inner end of the first path will also be propagated along both the sixth and seventh paths to cut and open the outer ends of the second and third paths before the same detonation can be propagated through the first intersection to these outer ends of the second and third path.

Any of these embodiments can be used in the self-limiting explosive logic network described in my patent application filed concurrently with this application, which is cross-referenced above.

BRIEF DESCRIPTION OF THE DRAWINGS

The invention would be better understood, and further objects, features, and advantages thereof will become more apparent from the following description of the preferred embodiments, taken in conjunction with the accompanying drawing in which.

DESCRIPTION OF PREFERRED EMBODIMENT

Figure 1:
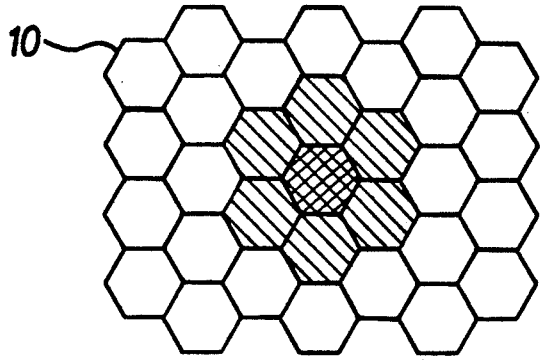
FIG. 1 is a plane view of an explosive panel in which the invention described herein may be utilized.
Figure 2:
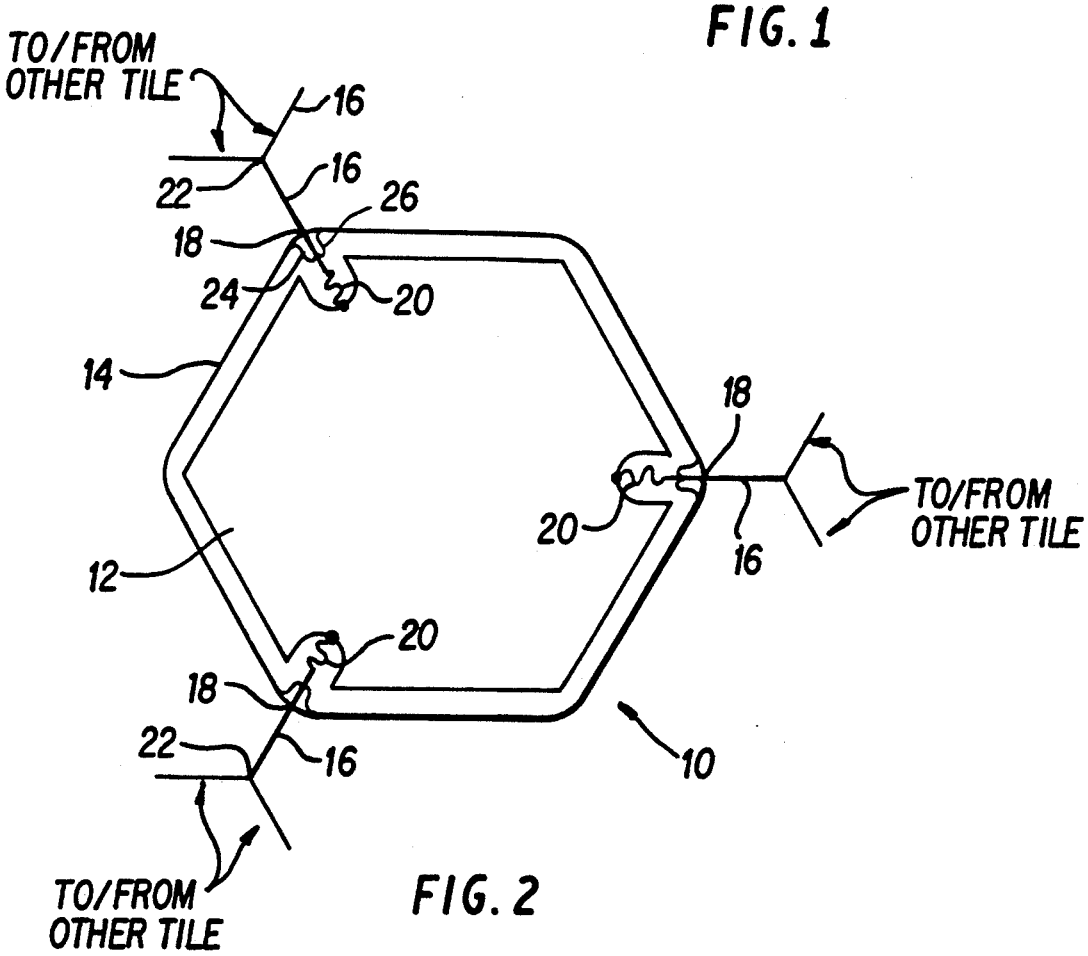
FIG. 2 is a schematic of an explosive tile assembly of the explosive panel of FIG. 1.

The above-referenced patent application entitled "Self Limiting Explosive Logic Networks" describes an explosive panel consisting of an array of identical, interconnected, non-overlapping explosive tile assemblies 10, as shown in FIG. 1 herein. Each of these tile assemblies includes an explosive tile 12, and an explosive peripheral path 14 which extends about the tile 12 and is buffered from it. The tile assembly 10 includes three explosive connecting links 16 which intersect the peripheral trail 14 at respective destructive crossovers 18. The inner end of the connecting links 16 are connected to the explosive tile 12 through respective identical explosive delay trails 20. The outer end of each connecting link 16 is connected to the outer ends of two connecting links 16 of two adjacent tile assemblies 10 at a junction 22.

Thus, each explosive tile 12 is connected to every adjacent explosive tile 12 by an explosive path consisting of a delay trail 20 and connecting link 16 of one tile assembly 10 connected in series with a connecting link 16 and delay trail 20 of the adjacent tile assembly 10.

Figure 3:
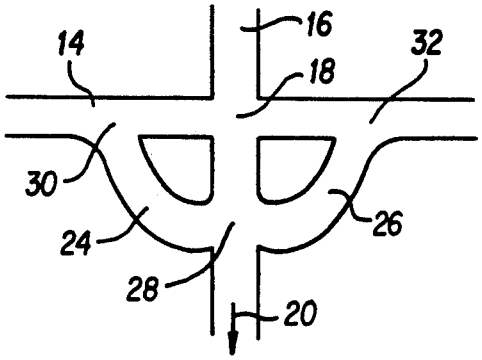
FIG. 3 is a representation of an explosive logic network of the tile assembly of FIG. 2.

Each connecting link 16 is also connected to the peripheral trail 14 on both sides of the destructive crossover 18 by two explosive paths 24, 26, as shown in FIG. 3. These explosive paths 24 and 26 intersect the connecting links 16 at an acute angle at a junction 28 disposed between the destructive crossover 18 and the delayed path 20, so that a detonation proceeding from the outer end of the connecting link 16 inwardly to the tile 12 will also initiate detonation of the two explosive paths 24 and 26. The two explosive paths 24 and 26 intersect the peripheral trail 14 at acute angles at respective junctions 30, 32 so as to direct detonations propagating along the explosive paths 24, 26 away from the junction 28 into the peripheral trail 14 in a direction away from the connecting link 16.

Figure 4:
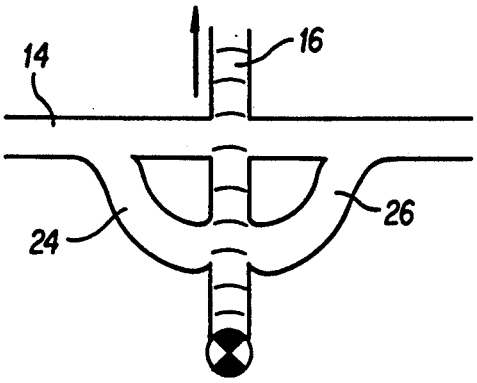
FIGS. 4, 5, and 6 illustrate respective modes of operation of the logic network of FIG. 3.
Figure 5:
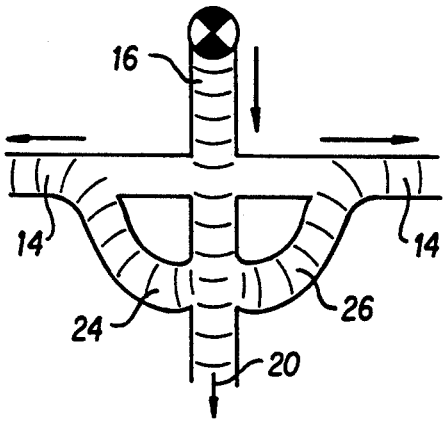
Figure 6:
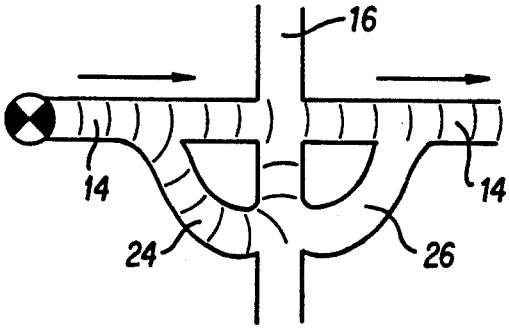

When a detonation is originated in any tile 12, it will respectively propagate through the three delay trails 20 and connecting links 16 of that tile assembly to the adjacent tile assemblies, as shown in FIG. 4. When an incoming detonation arrives at an adjacent tile assembly 10, it will propagate from the outer end of one connecting link 16 through the connecting delay trail 20 to the tile 12. It will also propagate in both directions along the peripheral path 14 crossing the connecting link 16, as shown in FIG. 5. The peripheral path 14 and the delayed trails 20 of each tile assembly 10 are designed so that before an incoming detonation along one connecting link 16 can propagate through the connected delayed trail 20, the tile 12, and another delayed trail 20 to one of the other two connecting links 16, the parallel detonation of the peripheral path 14 proceeding in both directions from the one connecting link 16 will have already cut the other connecting links, as shown in FIG. 6. Thus, an incoming detonation to a tile assembly 10 is limited solely to the explosive tile 10 of that tile assembly. When a detonation is initiated at any point and one tile of the explosive panel, it will be limited to that one tile and those tiles immediately adjacent to that one tile.

The reliability of this self-limiting explosive logic network depends chiefly on the reliability of the destructive crossovers 18. Thus, whenever a detonation is initiated in the tile 12 of one tile assembly 10, twelve destructive crossovers 18 of the six adjacent tile assemblies must function properly in order to limit the detonation to the initiation tile and the immediately adjacenttiles. For example, if 90% system reliability is required, each destructive crossover 18 must have a 0.991 reliability (0.996 reliability for each corner). Thus, anything which can be done to improve the reliability of these crossovers 18 will greatly improve the reliability of the overall logic network.

As shown in FIGS. 4–6, the peripheral path 14 intersects the connecting links 16 at a 90 degree angle at the destructive crossover 18. Normally, a detonation propagating in either direction along the peripheral path 14 will pass through the crossover 18 without propagating the detonation to either the outer or inner portions of the connecting link 16. It is essential that the detonation not be propagated to the outer portion of the connecting links 16, to prevent detonation of the adjacent tiles connected to the link 16. However, there is no necessity for preventing the detonation from propagating in the inner portion of the connecting link 16, since the tile 12 connected to the inner portion is to be detonated anyway.

To enhance the reliability of the crossover 18 in preventing a detonation along the peripheral path 14 entering the crossover from propagating along the outer portion of the connecting link 16, the angle of intersection between the peripheral path 14 and both sides of the connecting link 16 can be changed to direct a detonation proceeding along the peripheral path 14 in either direction towards the inner portion of the link 16 and away from the outer portion of this link. This can be achieved by two techniques, namely, changing the angle of the peripheral path 14 and tapering the peripheral path at the intersection 18, as discussed in my U.S. patent application Ser. No. 797,062 filed Nov. 12, 1985.

Figure 7:
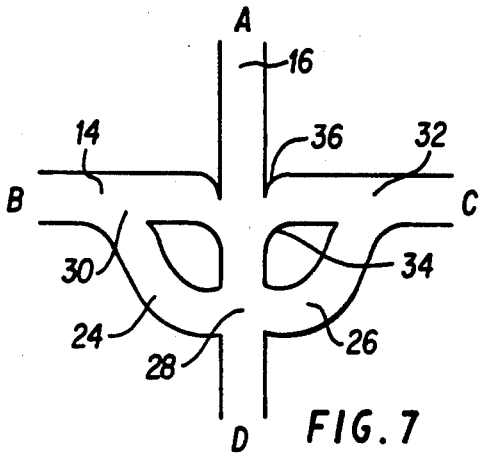
FIG. 7 is a schematic of a first embodiment of the invention.

Both of these techniques have been utilized in the embodiment of the invention shown in FIG. 7. In this embodiment, the peripheral trail 14 on both sides of the connecting link 16 are curved towards the inner end D of the connecting link 16, as indicated at 34. Also, on both sides of the link 16, the side of the peripheral path 14 adjacent the outer portion of the path 16 is tapered inwardly, as shown at 36, to further change the angle of the intersection of the two paths 14, 16. The portion of the peripheral path 14 between the intersection 30 and the intersection 18 is shorter than the trail 24 between the intersection 30 and the intersection 28 to insure that a detonation propagating from B along the peripheral path 14 will be directed at the intersection 18 towards the inner end D of the connecting link 16 to thus cut the outer portion of the link 16 before the same detonation can be propagated along the trail 24 and across the intersection 18 to the outer portion of the link 16. Similarly, the portion of the peripheral path 14 between the intersection 32 and 18 is shorter than the trail 26 between the intersection 32 and the intersection 28. This is all that is required when this explosive logic network is used in the tile assemblies of the explosive panel described above, which include only three connecting links. It is not necessary that a detonation propagating along the peripheral path 14 actually cross the connecting link 16 and continue along the peripheral path 14, since in the tile assemblies 10 described above, an incoming detonation along a first link is propagated in both directions along the peripheral path 14, so that the detonation in one direction need only cut the second link and the detonation in the opposite direction need only cut the third link.

However, in some applications, it is desired that a detonation proceeding along the peripheral path 14 not only cut the connecting link 16 but also continue along the peripheral path 14 away from the link 16. For example, in the tile assembly 10 described above, it may be desirable to design the peripheral path 14 and the delay trails 20 such that if there is a discontinuity in the peripheral path 14, the detonation can proceed around the peripheral path 14 in only one direction and cut both of the two outgoing connecting links. Also, the explosive logic network shown in FIG. 7 can be used for other applications in which a detonation propagating along the path 14 must cross over the connecting link 16.

Figure 8:
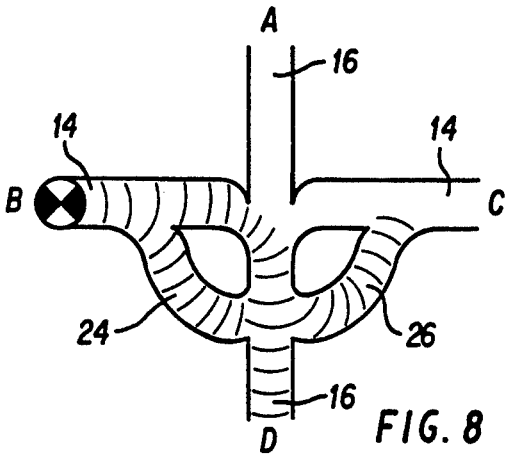
FIGS. 8, 9, and 10 illustrate respective modes of operation of the explosive logic network of FIG. 7.
Figure 9:
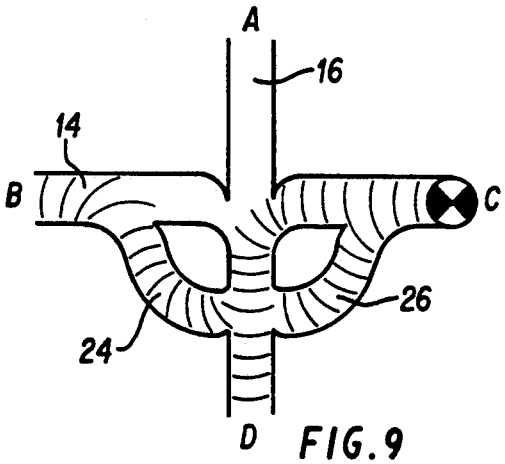

To assure that a detonation propagating from B along the peripheral path 14 will not only cut the link 16 but will also continue along the path 14 in the direction of C, the explosive path between the junctions 30 and 28 passing through the junction 18 is made shorter than the explosive trail 24 between the same two junctions 30 and 28. Similarly, the explosive path between the junctions 32 and 28 passing through the junction 18 is made shorter than the explosive path 26 between the same two junctions 32, 28. This arrangement assures that a detonation propagating along the peripheral path 14 from B towards the connecting link 16 will be deflected inwardly along the link 16 at the intersection 18, and will then be deflected into the trail 26 at the intersection 28 before the same detonation can propagate along the path 24 and be deflected outwardly along the link 16 at the intersection 28, as shown in FIG. 8. Similarly, a detonation proceeding along the peripheral path 14 from C towards the link 16 will cross the connecting link 16 and continue along the peripheral path 14 in the direction of B, as shown in FIG. 9.

Figure 10:
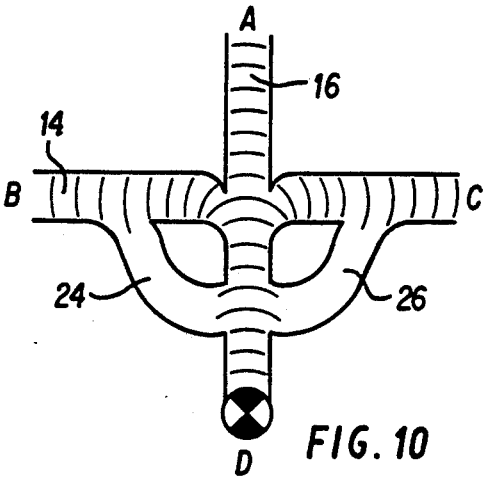

An incoming detonation along the connecting link 16 from A will also be propagated along the peripheral path 14 on both sides of the connecting link 16, in a similar manner as shown in FIG. 5. An outgoing detonation along the connecting link 16 from D will also be propagated along the peripheral path 14 on both sides of the link 16, as shown in FIG. 10. In some applications, or under some circumstances, this may be undesirable. For example, in the explosive panel discussed above, if a detonation is initiated in one of the explosive tiles 12 so as to short or bypass one of the delay trails 20, the detonation may race around the peripheral path 14 and cut the two other connecting links 16 before the detonation can propagate through the tile and the delay trails 20 of these other connecting links, so that the tiles connected to these other connecting links will not be detonated. To prevent such an occurence, the explosive logic network shown in FIG. 7 can be modified as shown in FIG. 11 herein.

Figure 11:
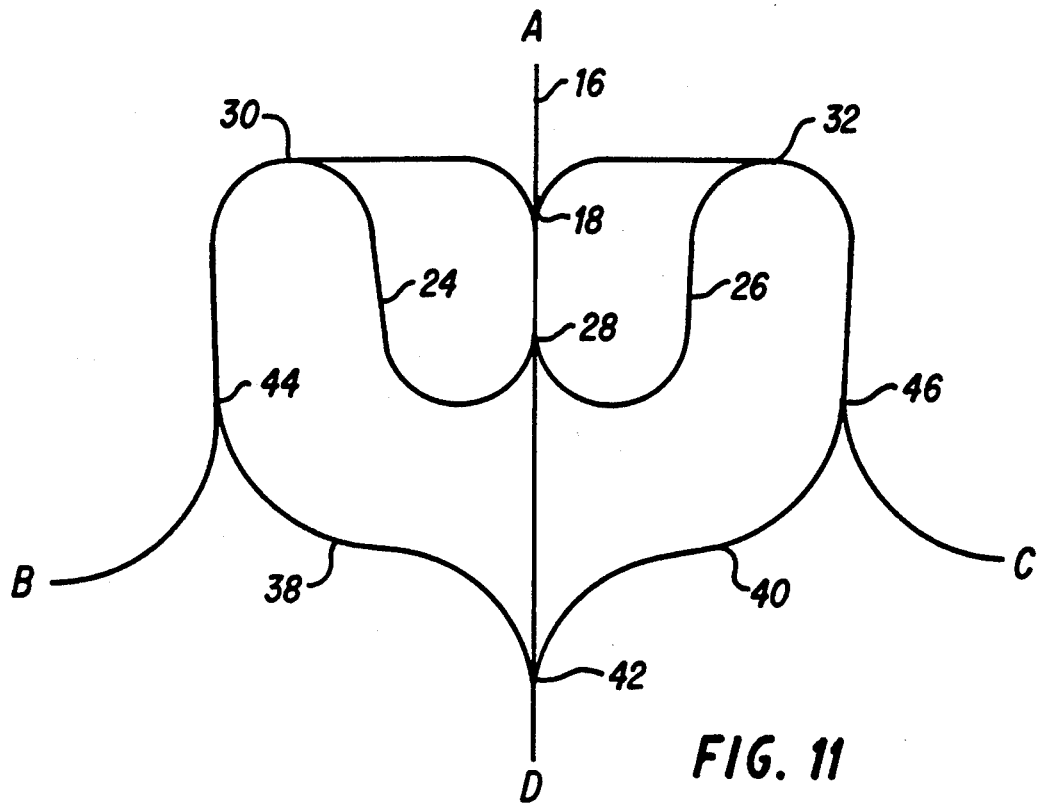
FIG. 11 is a schematic of a second embodiment of the invention.
Figure 12:
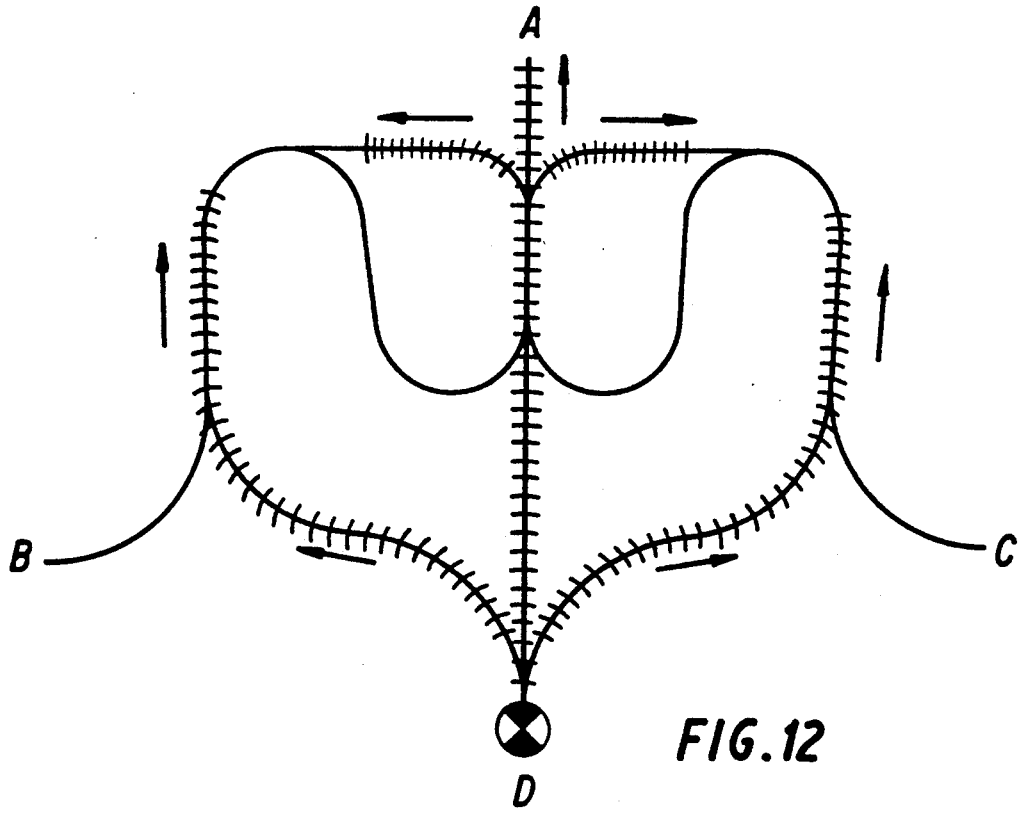
FIG. 12 illustrates one mode of operation of embodiment of FIG. 11.

The embodiment of FIG. 11 is similar to that of FIG. 7, except that the two opposite portions of the peripheral path 14 extending away from the crossover 18 are bent inwardly towards the point D of the connecting link 16, so that two additional explosive legs 38 and 40 can be added. The legs 38 and 40 intersect the connecting links 16 at an acute angle at an intersection 42 such that a detonation propagating outwardly along the connecting link 16 from D will also be propagated along both of these legs 38, 40. The leg 38 intersects the peripheral path 14 at an acute angle at an intersection 44, such that a detonation propagating along the leg 38 will be propagated from the intersection 44 along the peripheral path 14 towards the intersection 18, but will not be propagated along the peripheral path 14 towards B. Similarly, the leg 40 intersects the peripheral path 14 at an acute angle at an intersection 46 such that a detonation propagating along the leg 14 will be propagated from the junction 46 along the peripheral path 14 towards the junction 18, but will not be propagated in the reverse direction along the peripheral path 14 towards C. Thus, in the embodiment of FIG. 11, a detonation proceeding outwardly from D along the connecting link 16 is propagated to point A at the outer end of the link 16 without being propagated to the end points B and C of the peripheral path 14. The two portions of the peripheral path are bent inwardly, to assure that the two legs 38, 40 are much shorter than the parallel explosive path between the ends of these legs 38, 40 passing through the intersection 18. Thus, the leg 38 extending between the junctions 42 and 44 is much shorter than the explosive path extending from the junction 42, through the junctions 28, 18, and 30 to the junction 44. Similarly, the leg 40 extending between the junction 42 and 46 is much shorter than the parallel explosive path extending from the junction 42 through the junctions 28, 18, and 32 to the junction 46. In this arrangement, any detonation proceeding along the link 16 from D will be propagated to A at the outer end of the link 16 without being propagated to the outer ends B, C of the peripheral path 14, as shown in FIG. 12. Thus, the explosive logic network shown in FIG. 11 not only performs the same function as the network shown in FIG. 3, but also performs this function far more reliably.

There are many possible variations of the invention. For example, there is no need to utilize the corner effect at the intersection 28. This intersection can be constructed such that a detonation entering this intersection from either of the trails 24, 26 or in either direction along the connecting link 16 would propagate to all other paths entering this intersection. In such arrangement, a detonation propagating along the path 14 on one side of the link 16 towards the intersection 18 could cross over the link 16 and continue along the path 14 by way of the two trails 24, 26. In such an embodiment, the length of the path 14 between the intersections 30 and 18 would still have to be shorter than the length of the parallel path between these intersections 30 and 18 through the path 24 and intersection 28, and the length of the path 14 between the intersections 32 and 18 would still have to be shorter than the parallel explosive path between these intersections 32, 18 through the trail 26 and intersection 28 in order to assure that the outer portion of the connecting link 16 is cut and opened by a detonation proceeding in either direction along the path 14. Similarly, there is no need to utilize the corner effect at the intersections 30 and 32, although there would appear to be no advantage, for example, in propagating a detonation in the trail 24 in both directions along the path 14 from the intersection 30.

Since there are many modifications, variations, in addition to the invention which would be obvious to one skilled in the art, it is then intended that the scope of this invention be limited only by the appended claims.

What is claimed and desired to be secured by Letters Patent of the United States is:

1. An explosive logic network, comprising:

a first explosive path extending from a first end to an opposite end;

second and third explosive paths which are disposed on opposite sides of the first path and which intersect the first path at a common intersection intermediate the first and second ends of the first path, the second and third paths approaching the common intersection at respective acute angles between the second and third paths and a first portion of the first path extending from the common intersection towards the first end of the first path, and the sides of the second paths adjacent the first portion of the first path being respectively tapered inwardly to further reduce the respective acute angles at which the second and third paths intersect the first path.

2. An explosive logic network comprising:

a first explosive path extending from a first end to an opposite second end;

second and third explosive paths which are disposed on opposite sides of the first path and which intersect the first path at a first intersection, the second and third paths extending from respective outer ends to the first intersection, the second and third paths intersecting the first path at respective acute angles such that a detonation propagating along either the second or third paths into the first intersection is allowed to propagate along the first path toward the second end of the first path but is not allowed to propagate along the first path towards the first end of the first path; and fourth and fifth explosive paths which are disposed on opposite sides of the first path and which intersect the first path at a second intersection intermediate the first intersection and the second end of the first path such that a detonation propagating along the first path towards the second end of the first path is also allowed to propagate along both the fourth and fifth path away from the second intersection, the fourth path being disposed on the same side of the first path as the second path and the fifth path being disposed on the same side of the first path as the third path, the fourth path intersecting the second path at a third intersection such that a detonation propagating along the fourth path away from the second intersection is allowed to propagate along the second path towards the outer end of the second path, and the fifth path intersecting the third path at a fourth intersection such that a detonation propagating along the fifth path away from the second intersection is allowed to propagate along the third path towards the outer end of the third path, wherein the portion of the second path extending between the third intersection and a first intersection is shorter than the explosive path between the third intersection and the first intersection which passes through the second intersection, and the portion of the third path extending between the fourth intersection and the first intersection is shorter than the explosive path between the fourth intersection and the first intersection which passes through the second intersection.

3. An explosive logic network, as described in claim 2, wherein:

the side of the second path closest to the first end of the first path is tapered inwardly adjacent to the first intersection, to further reduce the acute angle at which the second path intersects the first path; and the side of the third path closest to the first end of the first path is tapered inwardly adjacent to the first intersection, to further reduce the acute angle at which the third path intersects the first path.

4. An explosive logic network, as described in claim 2, wherein:

the fourth path is longer than the path between the third intersection and the second intersection which passes through the first intersection; and the fifth path is longer than the path between the fourth intersection and the second intersection which passes through the first intersection.

5. An explosive logic network, as described in claim 2, which further comprises sixth and seventh explosive paths which are disposed on opposite sides of the first path and which intersect the first path at a fifth intersection intermediate the second intersection and the second end of the first path such that a detonation propagating along the first path from the second end of the first path towards the first end of the first path is also allowed to propagate along both the sixth and seventh paths away from the fifth intersection, the sixth path being disposed on the same side of the first path as the second path and the seventh path being disposed on the same side of the first path as the third path, the sixth path intersecting the second path at a sixth intersection intermediate the third intersection and the outer end of the second path, and the seventh path intersecting the third path at a seventh intersection intermediate the fourth intersection and the outer end of the third path, the sixth path intersecting the second path at an acute angle such that a detonation propagating along the sixth path into the sixth intersection is allowed to propagate along the second path towards the third intersection but is not allowed to propagate along the second path towards the outer end of the second path, the seventh path intersecting the third path at an acute angle such that a detonation propagating along the seventh path into the seventh intersection is allowed to propagate along the third path towards the fourth intersection but is not allowed to propagate along the third path towards the outer end of the third path, the sixth path being the shortest explosive path between the fifth intersection and the sixth intersection, and the seventh path being the shortest explosive path between the fifth intersection and the seventh intersection.

6. An explosive logic network, as described in claim 5, wherein;

the side of the second path closest to the first end of the first path is tapered inwardly adjacent the first intersection, to further reduce the acute angle at which the second path intersects the first path; and the side of the third path closest to the first end of the first path is tapered inwardly adjacent the first intersection, to further reduce the acute angle at which the third path intersects the first path.

7. An explosive logic network, as described in claim 5, wherein;

the side of the sixth path closest to the outer end of the second path is tapered inwardly ajdacent the sixth intersection, to further reduce the acute angle at which the sixth path intersects the second path; and the side of the seventh path closest to the outer end of the third path is tapered inwardly ajdjacent the seventh intersection, to further reduce the acute angle in which the seventh path intersects the third path.

8. An explosive logic network, as described in claim 5, wherein:

the fourth path is longer than the path between the third intersection and the second intersection which passes through the first intersection; and the fifth path is longer than the path between the fourth intersection and the second intersection which passes through the first intersection.

9. An explosive logic network, comprising;

a first explosive path extending from a first end to an opposite second end;

second and third explosive paths which are disposed on opposite sides of the first path and which intersect the first path at a first intersection, the second and third paths extending from respective outer ends to the first intersection, the second and third paths intersecting the first path at respective acute angles such that a detonation propagating along either the second path or the third path into the first intersection is allowed to propagate along the first path towards the second end of the first path but is not allowed to propagate along the first path towards the first end of the first path;

fourth and fifth explosive paths which are disposed on opposite sides of the first path and which intersect the first path at a second intersection intermediate the first intersection and the second end of the first path such that a detonation propagating along the first path from the second end of the first path toward the first end of the first path is also allowed to propagate along both the fourth and fifth paths away from the second intersection, the fourth path being disposed on the same side of the first path as the second path and the fifth path being disposed on the same side of the first path as the third path, the fourth path intersecting the second path at a third intersection intermediate the first intersection and the outer end of the second path and the fifth path intersecting the third path at a fourth intersection intermediate the first intersection and the outer end of the third path, the fourth path intersecting the second path at an acute angle such that a detonation propagating along the fourth path into the third intersection is allowed to propagate along the second path towards the first intersection but is not allowed to propagate along the second path towards the outer end of the second path, the fifth path intersecting the third path at an acute angle such that a detonation propagating along the fifth path into the fourth intersection is allowed to propagate along the third path toward the first intersection but is not allowed to propagate along the third path toward the outer end of the third path, the fourth path being the shortest explosive path between the second intersection and the third intersection, and the fifth path being the shortest explosive path between the second intersection and the fourth intersection.

10. An explosive logic network, as described in claim 9, wherein:

the side of the second path closest to the first end of the first path is tapered inwardly adjacent the first intersection, to further reduce the acute angle in which the second path intersects the first path; and the side of the third path closes to the first end of the first path is tapered inwardly adjacent the first intersection, to further reduce the acute angle at which the third path intersects the first path.

11. An explosive logic network, as described in claim 9, wherein:

the side of the fourth path closest to the outer end of the second path is tapered inwardly adjacent the third intersection, to further reduce the acute angle at which the fourth path intersects the second path; and the side of the fifth path closest to the outer end of the third path is tapered inwardly adjacent the fourth intersection, to further reduce the acute angle at which the fifth path intersects the third path.

12. An explosive panel including a plurality of interconnected explosive tile assemblies, each tile assembly comprising:

a tile of explosive material;

a peripheral path of explosive material extending about the tile;

a plurality of connecting links of explosive material, each extending from a inner end across the peripheral path at a first intersection to an outer end which is connected to a link outer end of at least one adjacent tile assembly, the number of links being sufficient to connect the tile assembly to every adjacent tile assembly, portions of the peripheral path on opposite sides of each link being directed inwardly of the tile as the peripheral path approaches the first intersection such that the link and the portions of the peripheral path on opposite sides of the link intersect at respective acute angles between the peripheral path portions and an outer portion of the link extending outwardly from the first intersection, such that a detonation propagating along the peripheral path in either direction towards the connecting link will propagate inwardly along the link to open the outer portion of the link;

a like plurality of first explosive logic means, associated respectively with the connecting links, for propagating an incoming detonation to the tile assembly along the associated link from an adjacent tile assembly in opposite directions away from the associated link along the peripheral path; and a like plurality of explosive delay means, connected respectively between the inner ends of the connecting links and the tile, for delaying an incoming detonation along any link so that the detonation will be propagated about the peripheral path and all other connecting links of the tile assembly will be cut before the detonation can be propagated through the tile to any other of the connecting links.

13. An explosive panel, as described in claim 12, wherein the outer side of the peripheral path is tapered inwardly along the peripheral path approaches to each connecting link, to further reduce the acute angles of intersection between the peripheral path and the link.

14. An explosive panel, as described in claim 12, wherein each first explosive logic means comprises:

a first trail of explosive material disposed on one side of the associated link, the first trail having one end connected to the associated link at a second intersection intermediate the first intersection and the inner end of the associated link such that a detonation propagating from the outer end to the inner end of the associated link is also propagated along the first trail, the first trail having an opposite end which intersects the peripheral path at a third intersection on the one side of the associated trail such that a detonation propagating along the first trail into the third intersection is propagated along the peripheral path away from the first intersection, the first trail being longer than the portion of the peripheral path between the first and third intersections; and a second trail of explosive material disposed on the opposite side of the associated link, the second trail having one end connected to the associated link at the second intersection such that a detonation propagating from the outer end to the inner end of the associated link is also propagated along the second trail, the second trail having an opposite end which intersects the peripheral path at a fourth intersection on the opposite side of the associated trail such that a detonation propagating along the second trail into the fourth intersection is propagated along the peripheral path away from the first intersection, the second trail being longer than the portion of the peripheral path between the first and fourth intersections.

15. An explosive panel, as described in claim 14, wherein:

the first trail is longer than the parallel explosive path between the second and the third intersections passing through the first intersection; and the second trail is longer than the parallel explosive path between the second and fourth intersections passing through the first intersection.

16. An explosive panel, as described in claim 12, which further comprises a like plurality of second explosive logic means, associated respectively with the connecting links and actuated by a detonation propagating from the inner end to the outer end of the associated link, for cutting and opening the peripheral path at two points on opposite sides of the associated link before the detonation can propagate through the first intersection to the two points.

17. An explosive panel, as described in claim 16, wherein each second explosive logic means comprises:

a first path of explosive material disposed on one side of the associated link, the first path having one end connected to the associated link at a second intersection intermediate the first intersection and the inner end of the associated link such that a detonation propagating from the inner end to the outer end of the associated link is also propagated along the first path, the first path having an opposite end which intersects the peripheral path at a third intersection on the one side of the associated trail, the first path intersecting the peripheral path at an acute angle such that a detonation propagating along the first path into the third intersection is allowed to propagate along the peripheral path toward the first intersection but is not allowed to propagate along the peripheral path away from the first intersection, and the first path being the shortest explosive path between the second intersection and the third intersection; and a second path of explosive material disposed on the opposite side of the associated link, the second path having one end connected to the associated link at the second intersection such that a detonation propagating from the inner end to the outer end of the associated link is also propagated along the second path, the second path having an opposite end which intersects the peripheral path at a fourth intersection on the opposite side of the associated trail, the second path intersecting the peripheral path at an acute angle such that a detonation propagating along the second path into the fourth intersection is allowed to propagate along the peripheral path toward the first intersection but is not allowed to propagate along the peripheral path away from the first intersection, the second path being the shortest explosive path between the second intersection and the fourth intersection.

18. An explosive panel as described in claim 17, wherein:

the first path is tapered inwardly adjacent the third intersection, to further reduce the acute angle at which the first path intersects the peripheral path; and the second path is tapered inwardly adjacent the fourth intersection, to further reduce the acute angle at which the second path intersects the peripheral path.

* * * * *